United States Patent [19]

Jimenez

[11] Patent Number: 4,984,727

[45] Date of Patent: Jan. 15, 1991

[54] DEVICE FOR CUTTING A TEXTILE FILAMENT

[75] Inventor: Antonio Jimenez, Meyrin, Switzerland

[73] Assignee: Mefina S.A., Fribourg, Switzerland

[21] Appl. No.: 350,559

[22] PCT Filed: Sep. 13, 1988

[86] PCT No.: PCT/CH88/00159

§ 371 Date: Mar. 17, 1989

§ 102(e) Date: Mar. 17, 1989

[87] PCT Pub. No.: WO89/03447

PCT Pub. Date: Apr. 20, 1989

[30] Foreign Application Priority Data

Oct. 7, 1987 [CH] Switzerland ..... 3912/87

[51] Int. Cl.[5] ..... D05B 65/00

[52] U.S. Cl. ..... 225/83; 225/90; 112/285

[58] Field of Search ..... 225/82, 83, 85, 37, 225/60, 77, 35, 90, 51, 79, 86, 87; 112/285, 254

[56] References Cited

U.S. PATENT DOCUMENTS

| | | | |
|---|---|---|---|
| 268,012 | 11/1882 | Goodrich | 225/83 |
| 2,302,965 | 11/1942 | Lucia . | |
| 2,558,039 | 6/1951 | Carroll . | |
| 2,664,194 | 12/1953 | Sharp | 225/60 |
| 3,106,902 | 10/1963 | Foltis et al. . | |

FOREIGN PATENT DOCUMENTS

| | | | |
|---|---|---|---|
| 635380 | 3/1983 | Switzerland . | |
| 8107443 | 9/1981 | United Kingdom | 112/285 |

*Primary Examiner*—Hien H. Phan
*Assistant Examiner*—Allan M. Schrock
*Attorney, Agent, or Firm*—Young & Thompson

[57] ABSTRACT

The filament cutter comprises a shank (1) with a head (2) and a substantially cylindrical portion (4), applied against the head (2) by a spring (5). In the space (7,8) is disposed a cutting member (9), having notched recesses and so arranged that a filament engaged between the member (4) and the head (2) will come into engagement with the notches so as to be cut.

4 Claims, 1 Drawing Sheet

DEVICE FOR CUTTING A TEXTILE FILAMENT

There are already known devices for cutting a textile filament and holding at least one of its bits by pinching between two members urged toward each other by a spring, one of these members being constituted by the head of a shank, the other member surrounding this shank, space being provided between this other member and the head of the shank, a cutting means being disposed in said space. A device of this type is described for example in Swiss patent No. 635,380.

The invention has for its object to reduce the cost of manufacture of such a filament cutting device, while making its use easier.

To this end, the filament cutting device of the above type is characterized in that the cutting member is constituted by a member mounted on the portion of the shank which passes through said space, this member having at least one leg extending radially into said space, this leg having a slot extending to its end, the two portions of the leg located on each side of the slot being oriented so as to depart in opposite directions from a radial plane perpendicular to the axis of this latter, so as to provide between them a V-shaped throat.

The accompanying drawing shows schematically and by way of example an embodiment according to the invention.

Figure 1:
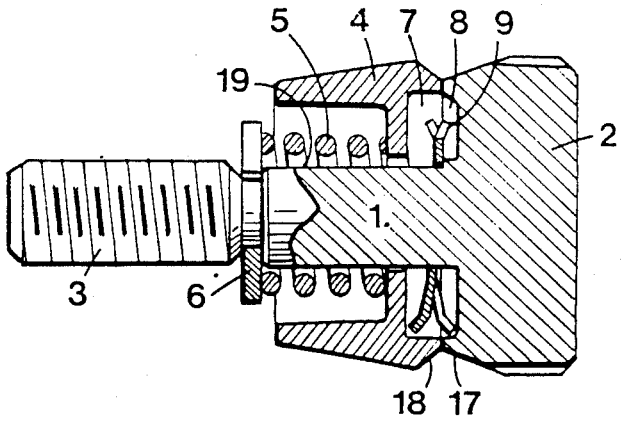

FIG. 1 an axial cross section of this embodiment.

Figure 2:
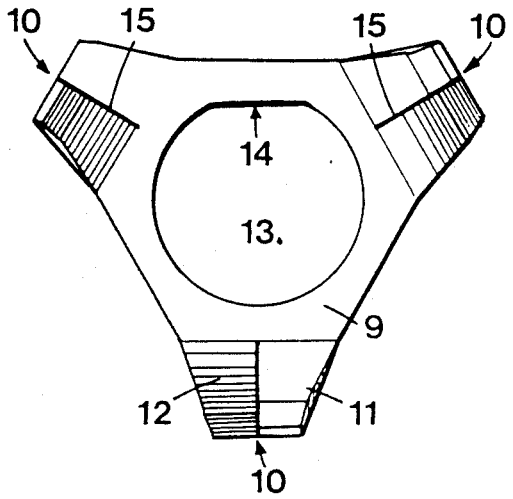
Figure 3:
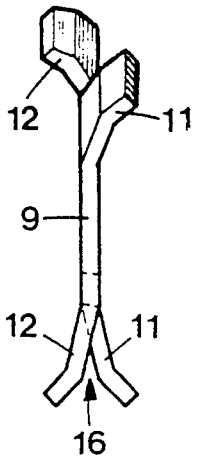

FIGS. 2 and 3 are respectively front and side views of the cutting member contained in the filament cutter according to FIG. 1.

Referring to FIG. 1, the device for cutting a textile filament and retaining at least one of its bits by pinching between two members, comprises a shank 1 having a head 2 and a screw-threaded portion 3, another portion 4 in the general shape of a sleeve can slide on shank 1 and is subjected to the action of a spring 5 bearing against a stop ring 6 to push this portion 4 until it comes into abutment against the head 2 of the shank 1.

The portion 4 has a circular recess 7 confronting a circular recess 8 of the head 2, these two recesses facing each other to define a space in which is disposed a cutting member 9, mounted on the portion of the shank 1 which passes through this space.

As shown in FIG. 2, the cutting member 9 is constituted by a steel plate stamped to have three legs 10 and a central hole 13 whose section is non-circular, thanks to a flat 14.

Each of the legs of the cutting member 9 has a slot 15 which divides the leg into two parts 11 and 12 which are oriented so as to diverge on opposite sides of a radial plane perpendicular to the shank 1, in a direction away from the axis of this shank. As is seen clearly in FIG. 3, the portions 11 and 12 form between them a V-shaped throat 16, these throats constituting the cutting portions of the member 9.

As shown in FIG. 1, the head 2 and the sleeve 4 have conical portions 17 and 18 respectively which confront each other to form a guide throat for the textile filament to be cut. Moreover, the shank 1 has a flat 19 adapted to cooperate with the flat 14 of the cutting member 9 so as to prevent the rotation of this member 9 on the shank 1.

To cut a textile filament, the user introduces this filament into the throat formed by the conical portions 17 and 18, which slightly spaces apart the sleeve 4 from the head 2 by a short distance against the action of spring 5. The filament enters the space 7, 8 and engages in at least one V of the cutting member 9. It should be noted that the V-shaped throats 16 of the member 9 are located substantially in the plane of contact of the head 2 with the sleeve 4. The filament being gripped between the sleeve 4 and the head 2, it suffices to exert a pull on a bit of the thread to force it toward the bottom of the throat 16 and easily achieve its cutting. After this operation, the other bit of the thread remains pinched between the head 2 and the sleeve 4 and if necessary can be easily disengaged by a slight pull.

The described device can be secured by screwing, or in any other fashion, on any textile machine on which there is a need to cut a filament easily. This device can advantageously be combined with the securement of the presser foot of a sewing machine.

It is of course to be understood that numerous modifications of the described device can be made. Conceivably, the cutting member could have but one or two V-shaped legs, but tests have shown that a member with three legs gives better results. It will also be understood that the member 4 in the form of a sleeve could be secured to framework of a machine, the shank 1 then not having the screw threaded portion 3 and being adapted to move against the action of the spring 5. The head 2 of the shank 1 could be made integral with this latter by any known means, instead of being of one piece with this shank.

I claim:

1. A device to cut a textile thread and to retain at least one of its bits by pinching between two members urged against each other by a spring, one of these members being constituted by a head of a shank, the other member surrounding this shank, a space being provided between this other member and the head of the shank, a cutting member being disposed in said space, characterized in that the cutting member is constituted by a piece mounted on a portion of the shank which passes through said space, this piece having at least one leg extending radially into said space, this leg having a slot extending inwardly from its end, towards the shaft to define two parts of the leg located on either side of the slot and arranged to diverge outwardly from a radial plane perpendicular to the axis of the shaft, so as to provide between them a V-shaped throat for receiving and cutting the thread.

2. Device according to claim 1, characterized in that the cutting member has at least three similar legs.

3. Device according to claim 2, characterized in that the shank has a non-circular section, the cutting member having a hole of corresponding section to engage around this shank.

4. Device according to claim 2, characterized in that the cutting member is constituted by a steel plate stamped to form the V-shaped throats of the legs.

* * * * *